United States Patent [19]

van der Aker et al.

[11] 3,977,522

[45] Aug. 31, 1976

[54] PACKING CONTAINING ELECTRICAL COMPONENTS

[75] Inventors: Cornelis Gualtherus Josephus van der Aker, Geldrop; Jan Faber; Nelis van de Sluis, both of Eindhoven, all of Netherlands

[73] Assignee: U.S. Philips Corporation, New York, N.Y.

[22] Filed: Nov. 18, 1974

[21] Appl. No.: 524,705

Related U.S. Application Data

[63] Continuation of Ser. No. 338,075, March 5, 1973.

[30] Foreign Application Priority Data

Aug. 3, 1972 Netherlands ..... 7210634

[52] U.S. Cl. ..... 206/330; 206/331; 206/382; 206/486; 206/820

[51] Int. Cl.[2] ..... B65D 73/02; B65D 85/42; B65D 85/28

[58] Field of Search ..... 206/328, 329, 330, 331, 206/347, 382, 486, 490, 820; 339/17 EF

[56] References Cited

UNITED STATES PATENTS 3,673,543 6/1972 Garner.. ..... 206/328

*Primary Examiner*—William Price
*Assistant Examiner*—Douglas B. Farrow
*Attorney, Agent, or Firm*—Frank R. Trifari; David R. Treacy

[57] ABSTRACT

A packing containing electrical components, consisting of a strip of flexible material having holes in which the connection wires of the components are secured with a sliding fit. The components are inserted into a mounting panel by moving the wire ends into the panel.

3 Claims, 10 Drawing Figures

PACKING CONTAINING ELECTRICAL COMPONENTS

Figures 1, 2:
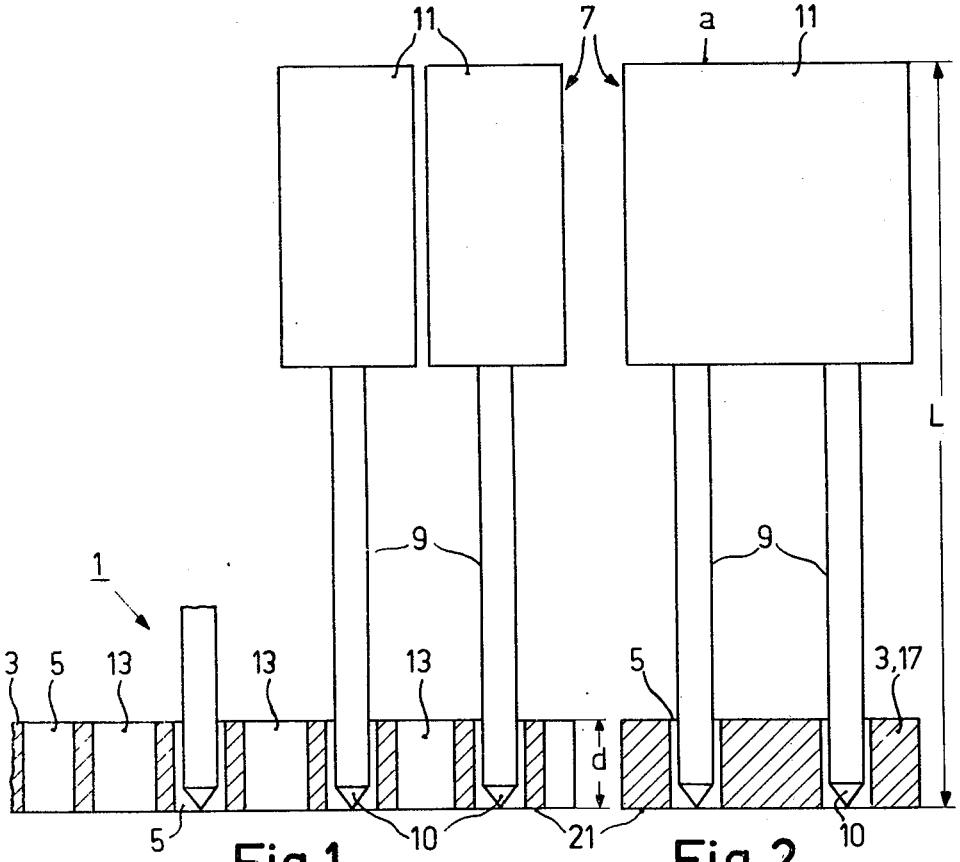

This is a continuation of application Ser. No. 338,075, filed Mar. 5, 1973.

The invention relates to a packing containing electrical components, consisting of a strip of flexible material which is provided with apertures in which the connection wires of the components are inserted, the connection wires extending in the same direction with respect to the body of the components, the strip being provided, between successive components, with cutouts which extend in the transverse direction and which divide the strip into sub-carriers which can be separated from each other.

In such a known packing the connection wires of the components are brought into a pattern by the sub-carriers, this pattern corresponding to the pattern of apertures in a printed circuit mounting panel on which the components are to be mounted. This packing is suitable for components having resilient connection wires such as, for example, tube holders. For components having comparatively thin connection wires of low rigidity, this packing is not very suitable because the connection wires are inserted through the apertures in the sub-carrier and cannot be reliably protected against undesired deformation.

For the mechanical mounting of electrical components on mounting panels the components can be supplied in an oriented manner and at a given distance from each other by means of a packing of the kind set forth. Because the pitch of the connection wires must obviously be very accurate, deformation of the connection wires during the transport of the components as well as during the feeding and insertion must definitely be prevented.

The invention has for its object to provide a packing which satisfies these requirements and which, moreover, is inexpensive and can be readily processed. This object is achieved according to the invention mainly in that the end of the connection wires is enclosed by the strip with a sliding fit.

As a result, the connection wires are protected during the transport of the packed components as well as during the feeding of the components to a mounting jig or insertion machine. A strip having an accurately defined profile can be inexpensively obtained by extrusion of a synthetic resin material which is provided with the apertures and cut-outs by means of a punching tool. The components are subsequently inserted into the apertures. In the case of components having axial connection wires, first one wire is bent such that both connection wires extend in the same direction. The strip with the components can either be cut in shorter sub-strips, be packed and transported, or it can be wound onto a reel. Before the mounting of a component on a mounting panel, a sub-carrier with the associated component is cut from the strip. The ends of the connection wires become exposed only during the mounting of the component when the sub-carrier is shifted in the direction of the component body; deformation of the connection wires is again prevented because, due to the sliding fit of the connection wires in the apertures, no substantial force is required for shifting the sub-carrier. The sub-carrier is permanently connected to the component and acts as a spacer and insulating element on the mounting panel.

It is to be noted that the protection of the connection wires of electrical components by means of a separate spacer is known. However, many operations are required for providing the spacers on the components and for packing the components in a packing which is suitable for mechanized mounting.

The components can be fed in the packing to a fully automatic inserting machine; however, such machines are very expensive, they are not very flexible and they are suitable only for large series. In a simpler and less expensive device the individual components are brought into a mounting jig, together with the sub-carrier, via tubes or ducts by using the force of gravity or compressed air. However, it must be prevented that the components become jammed in the ducts. With a preferred embodiment of the packing according to the invention this is achieved in that the projected surface of the components lies within the maximum dimensions of the sub-carriers. The profile of the ducts or pipes must be adapted merely to the circumference of the sub-carriers, regardless of the shape of the components. The sub-carriers act as a guide and reference member, and prevent rotation and tilting of the components as they pass through the ducts or tubes.

On the one hand, the connection wires must be sufficiently secure in the apertures of the strip so as to prevent undesired shifting of the components with respect to the strip during transport; on the other hand, the connection wires should not be too secure as otherwise excessively large forces must be exerted for inserting the components. The frictional forces between the connection wires and the strip are dependent on the tolerances in the wire dimensions and on the shape of the connection wires. These forces are controlled with narrow tolerances in a further embodiment of the packing according to the invention in which the circumference of the connection wires is in line contact with the inner circumference of the apertures in the strip. Round connection wires are inserted into square apertures, while square wires are inserted into round apertures or into square apertures, the aperture profile being turned through an angle of 45° with respect to the wire profile. Connection wires having a rectangular section are inserted into rhombic apertures which can also serve as a combination aperture for square and round wires.

In a further preferred embodiment of the packing according to the invention the strip is provided with tags formed by cuts in the strip, said tags surrounding the apertures and enclosing the connection wires in a resilient manner. Because the tags are elastically deformed to some extent when the connection wires are inserted so that they adapt themselves to the diameter of the connection wires, less narrow tolerances are permitted as regards the diameter of the connection wires. The tags which are bent from the bottom surface of the strip also serve as an abutment on the sub-carriers, and bear on the mounting panel when the components are mounted, so that the gases which are formed when the connection wires are soldered down can escape through the clearance which remains between the bottom surface of the sub-carrier and the mounting panel.

In a further preferred embodiment yet of the packing according to the invention the strip is provided with projecting edges on the bottom surface which is remote from the body of the components, the free end of the connection wires projecting from the bottom surface.

As a result, the components in the packing can be readily measured on their projecting ends, whilst their ends are still protected against deformation by the projecting edges. During the mounting of the components on a mounting panel, the edges of the individual sub-carriers will bear on the mounting panel, so that again a clearance is produced between the bottom surface of the sub-carriers and the mounting panel to allow the escape of the gases produced during soldering.

The invention will be described in detail with reference to the drawing.

Figure 3:
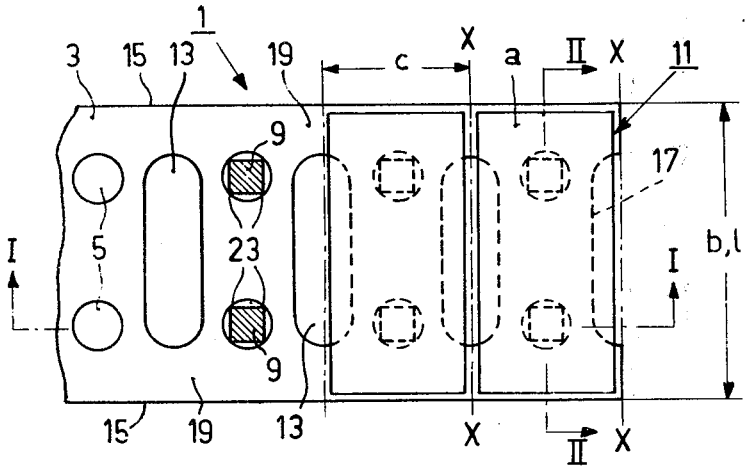
Figure 4:
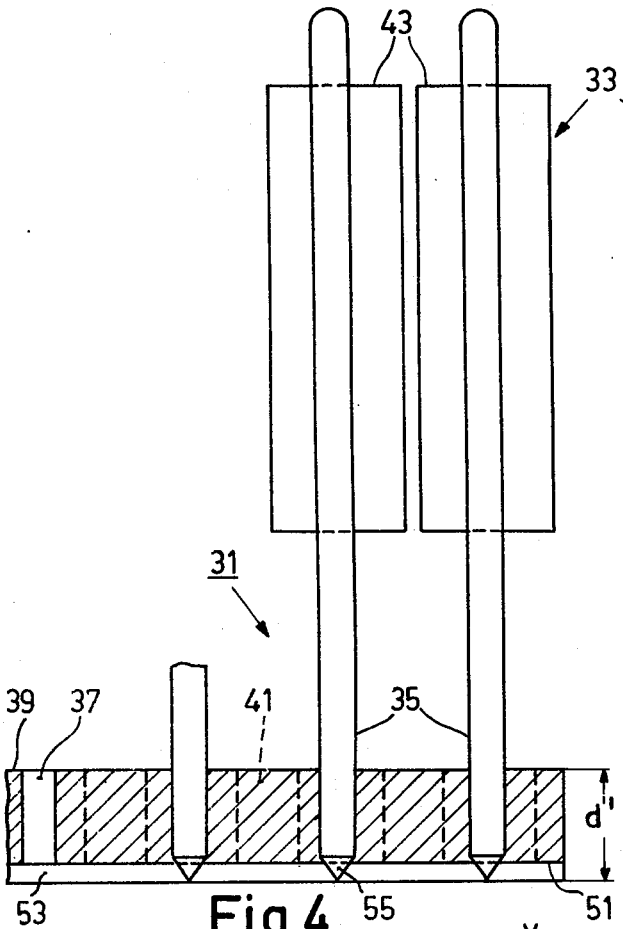
Figure 5:
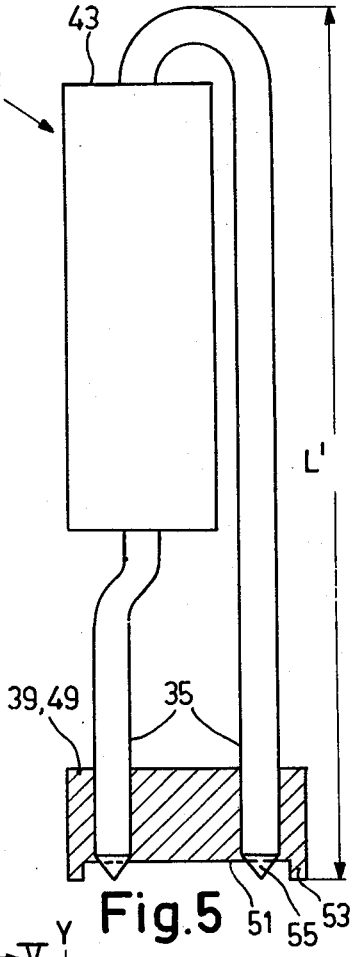
Figure 6:
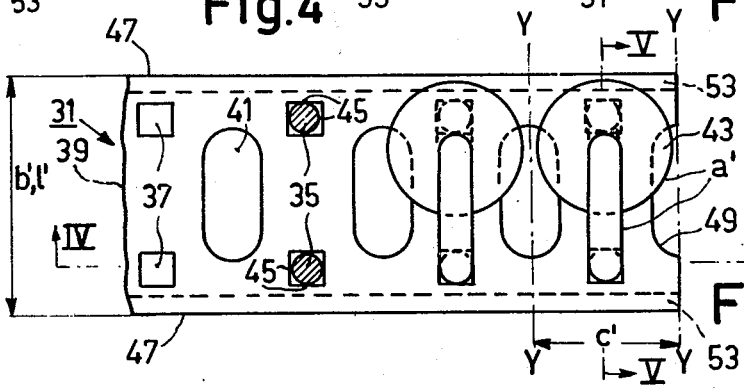

FIGS. 1, 2 and 3 are a longitudinal view, a sectional view, and a plan view, respectively, of an embodiment of the packing according to the invention, containing electrical components, FIGS. 4, 5 and 6 are a longitudinal sectional view, a cross-sectional view, and a plan view, respectively, of another embodiment of the packing according to the invention, and FIGS. 7, 8, 9 and 10 show special embodiments of strips which are suitable for the packing according to the invention.

The packing 1 as shown in FIGS. 1, 2 and 3 consists of a strip 3 which is made of a flexible material and which is obtained by extrusion of a suitable synthetic resin material. The strip 3 is provided, for example, by means of a punching tool, with regularly spaced apertures 5 which have a circular section in the embodiment shown.

The connection wires 9 of electrical components 7, ceramic plate capacitors in the present embodiment, are inserted into the apertures 5. The connection wires 9 extend in the same direction with respect to the prismatic body 11 of the components and have a square section. The strip 3 is provided with elongated cut-outs 13 between successive components which extend transverse to the longitudinal direction of the strip. In conjunction with the longitudinal edges 15 of the strip, the cut-outs 13 limit mainly the circumference of subcarriers 17 which are interconnected by breaking or cutting bridges 19. So as to achieve a wider tolerance in the positioning of the connection wires and to facilitate the insertion of the connection wires into the apertures of the strip and of a mounting panel, the free end 10 of the connection wires 9 is preferably pointed. The connection wires 9 are inserted into the apertures 5 such that their free end does not project from the bottom surface 21 of the strip 3 and is enclosed by the strip. The dimensions and the shape of the apertures 5 and of the connection wires 9 are adapted to each other such that the connection wires fit in the apertures with a sliding fit. The square connection wires 9 are in line contact with the inner circumference of the round apertures 5 at four locations 23 on their circumference. The projected surface $a$ of the component body lies within the maximum dimensions of the sub-carriers which have a length $l$ which is equal to the width $b$ of the strip, and a maximum width $c$ which is equal to the distance between the diameters X—X of two successive cut-outs. Before the insertion of a component 7 in a mounting panel, a sub-carrier 17 with the associated component is cut off along the middle line X—X of a cut-out 13. The strip 3 has a thickness $d$ which is comparatively large with respect to its width $b$ and which is at least equal to 0.1 times the overall length $l$ of the components. In a practical embodiment, the strip 3 had a width $b$ of 5 mm and a thickness $d$ of 1.5 mm, whilst the electrical component had an overall length L of 14.5 mm.

The FIGS. 4, 5 and 6 show a packing 31 containing resistors 33, the axial connection wires 35 of which are inserted into apertures 37 of the strip 39, the said strip furthermore being provided with cut-outs 41, the middle line of which is denoted by Y—Y. Before the resistors 33 are secured on the strip 39, one of the connection wires 39 must be bent such that both wires extend in the same direction with respect to the cylindrical body 43. In this embodiment the connection wires 35 have a circular section, whilst the apertures 37 have a square profile so that the wires are again in line contact with the inner circumference of the apertures at four locations 45 on their circumference. The projected surface $a'$ of the resistors 33, i.e. both of the component body 43 and of the connection wires 35, lies within the length $l'$ and the maximum width $c'$ of the sub carriers 49. In this embodiment the strip 39 is provided, on the bottom surface 51 which is remote from the components 33, with projecting edges which are formed by longitudinal ribs 53 in the embodiment shown. The pointed free ends 55 of the connection wires 35 project from the bottom surface 51 as far as the lower side of the longitudinal ribs 53. The strip can alternatively be provided with cams, ridges etc. instead of longitudinal ribs. Projecting edges can also be formed by providing cut-outs which enclose the apertures 37 in the bottom surface 51.

In a practical embodiment of the packing, the strip had a width $b'$ of 4 mm, a thickness $d'$ of 1.5 mm, the resistors 33 having an overall length L' of 14.5 mm.

Figure 7:
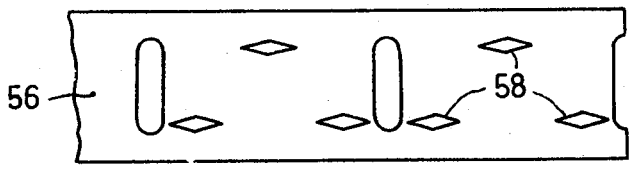

FIG. 7 shows a strip 16 of a special embodiment comprising rhombic apertures 58 which are particularly suitable for components whose connection wires have a rectangular section, but which is also suitable for components having round or square connection wires.

Components having a square profile can also be inserted into square apertures, the aperture profile then being turned through an angle of 45° with respect to the wire profile.

Figure 8:
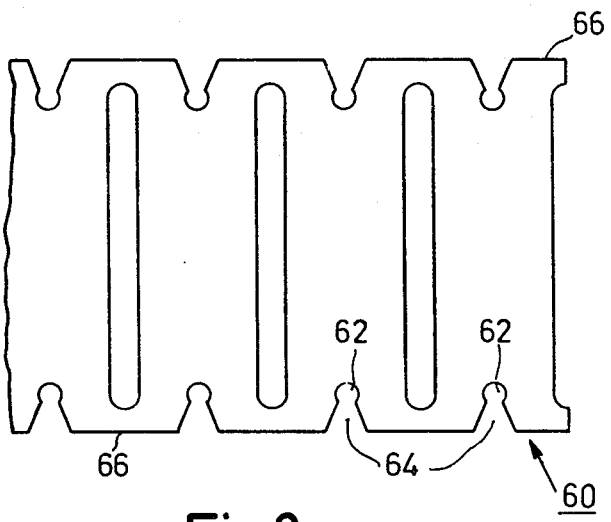

The strip 60 shown in FIG. 8 is particularly suitable for very vulnerable components, for example, coils whose connection wires are too flexible to be axially inserted into the apertures 62. To this end, the strip 64 is provided with notches which extend from the circumference of the apertures 62 to the longitudinal edges 66 of the strip so that the connection wires can be laterally pressed into the apertures.

Figure 9:
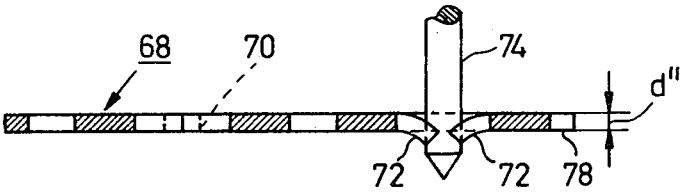
Figure 10:
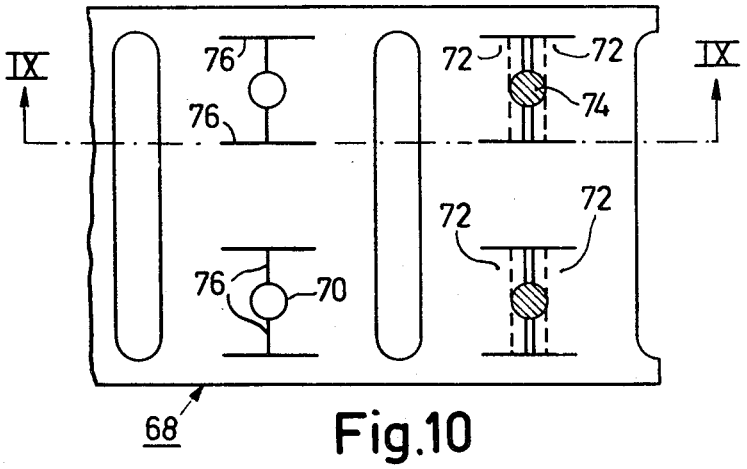

FIGS. 9 and 10 are a longitudinal sectional view and a plan view, respectively, of a strip in which the apertures 70 are enclosed by tags 72 which enclose the connection wires 74 of components not shown in a resilient manner. The tags 72 are obtained by means of cuts 76 in the strip. When the connection wires are inserted into the apertures 70, the tags 72 are bent away from the bottom surface 78 of the strip 68. The number of tags can be varied by providing more or less cuts per aperture. In this embodiment the strip has a thickness $d'$ which is equal to 0.02 to 0.04 times the overall length of the components.

The packing according to the invention is suitable for components of varying shapes and dimensions, the dimensions of the strip and of the apertures having to be adapted only to the dimensions and the shape of the components and of the connection wires.

What is claimed is:

1. A packing containing electrical components, comprising a plurality of electrical components, a component comprising a body portion, and connection wires extending in a first direction parallel to each other; and a strip of flexible insulating material, said strip having transverse cut-outs defining sequential sub-carrier portions, each sub-carrier portion having at least two holes therethrough, a sub-carrier and at least a corresponding component forming a sub-assembly comprising the sub-carrier and a component having its body portion in spaced relationship with the sub-carrier, end portions of the connection wires being received in the corresponding holes of the sub-carrier so as to hold said component in position and protect said end portions from lateral deformation, said sub-assembly being adapted to be cut from the strip for attachment to a mounting panel by inserting the ends of the connection wires into holes in the panel, and wherein said body portion of said component is spaced from the sub-carrier such that said sub-assembly is adapted to be attached to the panel by moving the body portion of the component toward the sub-carrier so that the connection wires pass through the holes in the sub-carrier to enter holes in the panel, whereby said sub-carrier portions of said strip are adapted to function as a spacer and insulating element on said panel.

2. A packing as claimed in claim 1, wherein said holes have a closed circumference, said holes having a shape different from a cross-section of said connection wires such that each wire contacts a respective hole in a plurality of line contacts so as to provide a sliding fit having a controlled sliding force.

3. A packing containing electrical components, comprising a plurality of electrical components, a component comprising a body portion, and connection wires extending in a first direction parallel to each other; and a strip of flexible insulating material, said strip having transverse cut-outs defining sequential sub-carrier portions, each sub-carrier portion having at least two holes therethrough, a sub-carrier and at least a corresponding component forming a sub-assembly comprising the sub-carrier and a component having its body portion in spaced relationship with the sub-carrier, end portions of the connection wires being received in the corresponding holes of the sub-carrier so as to hold said component in position and protect said end portions from lateral deformation, said sub-assembly being adapted to be cut from the strip for attachment to a mounting panel by inserting the ends of the connection wires into holes in the panel, and wherein said strip has edge portions projecting a first distance on a bottom side away from said electrical components, and wherein each connection wire has a free end projecting a distance equal to said first distance from said strip on said bottom side, whereby said sub-carrier portions of said strip are adapted to function as a spacer and insulating element on said panel.

* * * * *